US005203500A

United States Patent [19]

Horne, Sr.

[11] Patent Number: 5,203,500

[45] Date of Patent: * Apr. 20, 1993

[54] APPARATUS AND METHOD FOR CONVERTING AN ELECTRIC WATER HEATER TO USE GAS

[75] Inventor: Frank L. Horne, Sr., Charlotte, N.C.

[73] Assignee: Gas-Fired Products, Inc., Charlotte, N.C.

[ * ] Notice: The portion of the term of this patent subsequent to Jun. 4, 2008 has been disclaimed.

[21] Appl. No.: 708,750

[22] Filed: May 31, 1991

Related U.S. Application Data

[63] Continuation-in-part of Ser. No. 409,143, Sep. 19, 1989, Pat. No. 5,020,721.

[51] Int. Cl.[5] ..... F24D 3/08

[52] U.S. Cl. ..... 237/19; 237/8 R; 126/362; 236/20 R

[58] Field of Search ..... 237/8 R, 56, 19; 236/20 R; 126/362, 101

[56] References Cited

U.S. PATENT DOCUMENTS

| | | | |
|---|---|---|---|
| 2,577,694 | 12/1951 | Winn . | |
| 3,400,246 | 9/1988 | Zob . | |
| 3,659,560 | 6/1972 | Carter . | |
| 3,687,128 | 8/1972 | Williams . | |
| 3,705,574 | 12/1972 | Duncan . | |
| 4,155,506 | 5/1979 | Brosenius . | |
| 4,345,583 | 8/1982 | Morin . | |
| 4,416,256 | 11/1983 | Korwill . | |
| 4,543,468 | 9/1985 | Shaffer, Jr. et al. . | |
| 4,594,795 | 6/1986 | Stephansen . | |
| 4,724,798 | 2/1988 | Alspaugh . | |
| 4,785,792 | 11/1988 | Saint Laurent . | |
| 5,020,721 | 6/1991 | Horne | 236/20 R |

FOREIGN PATENT DOCUMENTS

| | | | |
|---|---|---|---|
| 0158433 | 3/1982 | Japan | 237/80 |
| 58-123041 | 7/1983 | Japan . | |

*Primary Examiner*—Henry A. Bennett

*Attorney, Agent, or Firm*—Bell, Seltzer, Park & Gibson

[57] ABSTRACT

An apparatus and method for providing a hot water supply for a building such as a mobile home, house, or business. A hot water storage tank is positioned within the building. A gas-fueled burner is positioned outside the building adjacent a heat exchanger which is connected in fluid communication with the indoor water storage tank. A pump circulates water from the tank through the heat exchanger and back into the tank responsive to a thermostat in the tank. The heat exchanger includes a thermostat for sensing the temperature of water therein to activate the pump and circulate relatively warm water from the tank through the heat exchanger to prevent freezing of water within the heat exchanger, such as during winter months when the ambient temperature falls below freezing. The gas heater may be used to convert a conventional electric water heater to operate from gas which is combusted outside of the building.

45 Claims, 6 Drawing Sheets

APPARATUS AND METHOD FOR CONVERTING AN ELECTRIC WATER HEATER TO USE GAS

RELATED APPLICATION INFORMATION

This is a continuation-in-part of application Ser. Number 07/409,143 filed Sep. 19, 1989, now U.S. Pat. No. 5,020,721.

FIELD OF THE INVENTION

The present invention relates to the field of water heaters and, more particularly, to an apparatus and method for converting an electric water heater to use gas.

BACKGROUND OF THE INVENTION

Just about every residence and almost all commercial establishments require a supply of hot water. The hot water is used for domestic or other purposes, the energy costs for which may comprise a large portion of the total energy bill. Electric water heaters are quite commonly used although natural or liquified gas, or other fuels, may be cheaper to use over the life of the water heater.

Electric water heaters, by definition, are used in all-electric homes. Many houses, when originally constructed, were outside the reach of existing natural gas distribution facilities. With the popularity of electric heat pumps for space heating in many parts of the country, all electric houses are common even where gas distribution facilities may now be available.

Electric water heaters are also especially common in mobile homes where the increased cost of venting the exhaust gasses from the interior of a mobile home encourages manufacturers to use initially cheaper electric water heaters. Thus, the purchase price of the mobile home may be lower; however, this initial savings may be quickly lost through the use of expensive electricity for heating water. In many areas, the heat obtained by electricity may be twice as costly as heat produced by gas. Gas also allows a much more rapid recovery, that is, gas combustion may transfer up to 60,000 BTU to the water in the same time that an electric heater would transfer only 15,000–20,000 BTU.

Regional gas companies, having a substantial investment in their gas distribution system, frequently have a huge demand from consumers in the winter for space heating, yet have a relatively small demand in the non-winter months. The return on the investment for the gas distribution system could be significantly increased if a more consistent gas demand existed year round. Since water heating typically may consume up to one third of the energy consumed in a home, gas suppliers have a strong incentive to convert electrical water heaters to operate from gas. The increased demand for gas would then be far less sensitive to seasonal demand and would allow the gas companies to operate their distribution systems at a greater efficiency.

The replacement of an existing electric water heater with a conventional gas water heater may raise legitimate safety concerns. For example, many individuals are reluctant to have a gas appliance within the home because of a perceived risk of a gas leak and a subsequent explosion. In addition, "tighter" energy efficient homes have a relatively low rate of air exchange. The combustion of gas within a home may lead to the accumulation of undesired and hazardous gasses within the tighter energy efficient homes. While a conventional gas water heater is typically vented to the outside, this venting requires that the heater be positioned near an exterior wall of the home or building. In many homes, a location near the exterior of the building may not be available. Accordingly, a simple substitution of a gas water heater for an electric water heater is often not practical or desirable.

SUMMARY OF THE INVNETION

It is therefore an object of the present invention to provide an apparatus for providing a hot water supply for a building such as a mobile home, house, business or the like, using combustion of gas outdoors.

It is another object of the present invention to provide an apparatus for heating water that is mounted outside a building and which is resistant to damage caused by freezing.

It is yet another object of the present invention to provide an apparatus and method for converting an existing electric water heater located inside a building to operate from gas combusted outside of the building.

These and other objects according to the present invention are provided by an apparatus for providing a hot water supply for a building such as a mobile home, house, business or the like. The apparatus includes a hot water storage tank positioned within the building and a gas burner and heat exchanger mounted in a housing outside of the building. An existing electric water heater that is modified as described below may provide the indoor hot water storage tank.

The housing is typically mounted outside of the building, such as on an exterior wall or on a concrete pad adjacent to the building. The housing includes a gas-fueled burner positioned therein and means for controlling gas flow thereto. A heat exchanger is positioned adjacent to the burner and within the housing. The heat exchanger has an inlet and an outlet connected in fluid communication with the hot water storage tank.

A pump is connected in fluid communication with the heat exchanger for circulating water from the hot water storage tank through the heat exchanger and back into the storage tank. The pump may be positioned within the housing or, alternately, may be positioned within the building. Heater control means, such as an electrical control circuit, is connected to a thermostat mounted on the storage tank, the pump, and the gas flow control means. The heater control means is for activating the pump and the burner so that water flows through and is heated in the heat exchanger when the temperature of the water in the hot water storage tank falls below a predetermined temperature.

The heat exchanger preferably includes a length of tubing having a relatively small fluid capacity of no more than a small fraction of the total capacity of the hot water storage tank. The pump preferably provides a relatively high flow of water of about 3 to 5 gallons per minute, and the burner and the heat exchanger preferably provide a temperature boost of no less than about 20° F. to water flowing through the heat exchanger so that a nearly continuous supply of hot water is provided during normal consumption.

The housing includes an exhaust opening and an air intake opening formed therein. The heat exchanger includes a chamber having an upper opening and a lower opening with the upper opening connected to the housing exhaust opening. The lower opening of the chamber is positioned adjacent the burner. A preheater formed of tubing in a spiral arrangement is positioned within a lower portion of the chamber for absorbing radiant heat from the operating burner. A primary heat exchanger is positioned above the preheater and includes a series of parallel spaced-apart heat transfer fins and a serpentine arrangement of tubing passing therethrough. The surfaces of the heat transfer fins and the serpentine tubing of the primary heat exchanger may include a black coating thereon to increase absorption of heat from the burner.

To prevent freezing damage to the heat exchanger and other components exposed to the outside weather, a thermostat is positioned within the housing and operatively connected to the pump so as to activate the pump when the temperature of water within the heat exchanger falls below a temperature of about no more than about 10° above freezing. Thus, relatively warm water is caused to circulate from the hot water storage tank through the heat exchanger to thereby prevent freezing of water in the heat exchanger.

In one embodiment according to the present invention, a standing pilot may be positioned adjacent the burner for igniting the burner. The standing pilot also provides heat to the heat exchanger to prevent freezing of water therein when the ambient temperature falls below freezing. The housing also preferably includes thermal insulation positioned adjacent the interior surface of the housing. The insulation reduces heat loss to the ambient air surrounding the housing to thereby increase operating efficiency and to reduce the heat required to prevent freezing of water in the heat exchanger when the ambient temperature falls below freezing.

The gas heater also preferably includes a high temperature thermostat positioned within the housing which is connected to the burner control means for shutting off the flow of gas to the burner when the temperature of water in the heat exchanger exceeds a predetermined high temperature. The high temperature thermostat protects the heat exchanger from damage, such as when the water flowing therethrough is overheated and converted to steam.

A flow detector is preferably positioned in fluid communication with the heat exchanger. The flow detector is connected to the control means for proving water flow through the heat exchanger prior to activating the burner. The flow detector prevents damage to the heat exchanger caused by operation of the burner without a sufficient water flow rate through the heat exchanger to cool the heat exchanger.

According to another aspect of the present invention, an existing electric water heater may be readily converted to operate from gas combusted outside of the building. A typical electric heater includes at least one fitting adapted for retaining an electric heating element therein. The electric heating element may be removed and the outlet of the heat exchanger connected in fluid communication with the tank through the electric heating element fitting. A generally L-shaped return tube may be positioned within the tank and connected thereto by a rotatable coupling at the electric heating element fitting. The return tube directs water flowing into the tank to mix with the relatively hot water in the upper regions of the hot water storage tank. The return tube has an angle of about 75° so that an end of the return tube opposite the coupler end remains in a generally upright orientation within the hot water storage tank by contact with the inner wall of the cylindrical storage tank. An electric water heater also has a valve adjacent a lower end thereof for draining water therefrom. The inlet of the heat exchanger may be connected in fluid communication with the indoor hot water storage tank adjacent the drain valve.

Another aspect of the present invetion is the abilty of the gas heater as described above to be used to supply heat for space heating of the buliding. For a space heating system that circulates hot water to radiant baseboard heating units, water may be circulated from the indoor hot water sorage tank to the baseboard units. For a building having a heating system including air ducts and a fan, a heat e4xchanger may be positioned in a duct of the heating system and ocnnected in fulid communication with the indoor hot water storage tank. A pump and thermostat may be used to circulate the water through the heat exchanger within the building, that is, either the radiant baseboard units or the duct mounted heat exchanger for thereby supplying heat for space heating of the building. The water from the heat exchanger is then returend to teh indoor water stroage tank.

DETAILED DESCRIPTION OF THE PREFERRED EMBOIDMENT

The present invention will now be described more fully hereinafter with reference to the accompanying drawings, in which a preferred embodiment of the invention is shown. This invention may, however, be embodied in many different forms and should not be construed as limited to the embodiment set forth herein. Rather, applicant provides this embodiment so that this disclosure will be thorough and complete, and will fully convey the scope of the invention to those skilled in the art. Prime notation is used herein to refer to similar elements.

Figure 1:
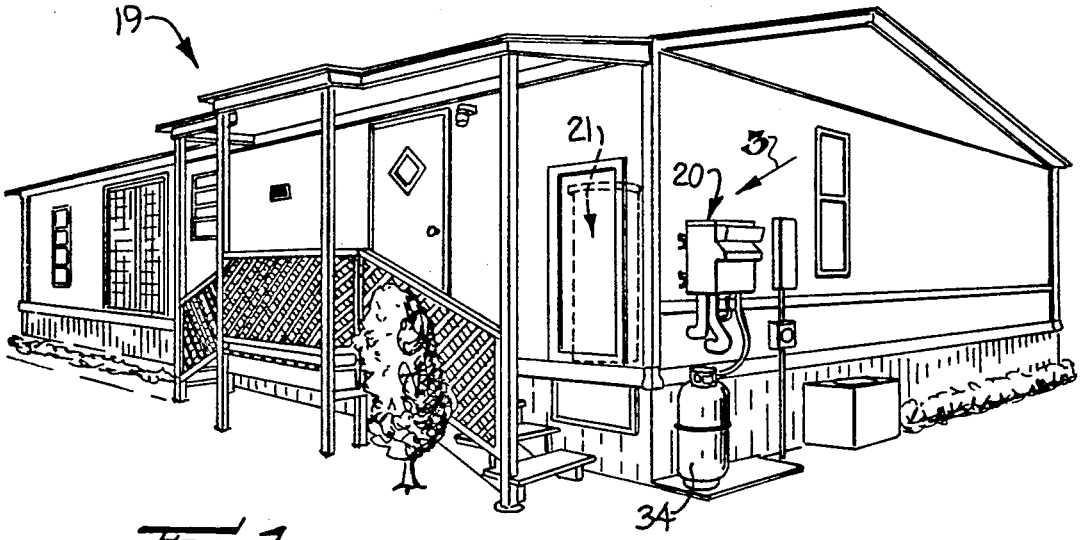
FIG. 1 is a schematic view of a mobile home with the gas water heater of the present invention associated therewith.

A gas water heater according to the present invention is generally designated by reference numeral 20 in the accompanying drawings. Referring to FIG. 1, there is shown the gas water heater 20 according to the present invention installed on the exterior of a mobile home 19. The gas water heater 20 is connected in fluid communication with an indoor hot water storage tank 21 for providing hot water thereto. The hot water may be drawn off from the storage tank 21 for typical domestic uses, such as showers, baths, washing clothes, washing dishes, etc. It would be readily understood by those skilled in the art that the gas heater 20 may be used for providing a supply of hot water for many other types of buildings, such as houses, businesses or other commercial establishments.

Figure 2:
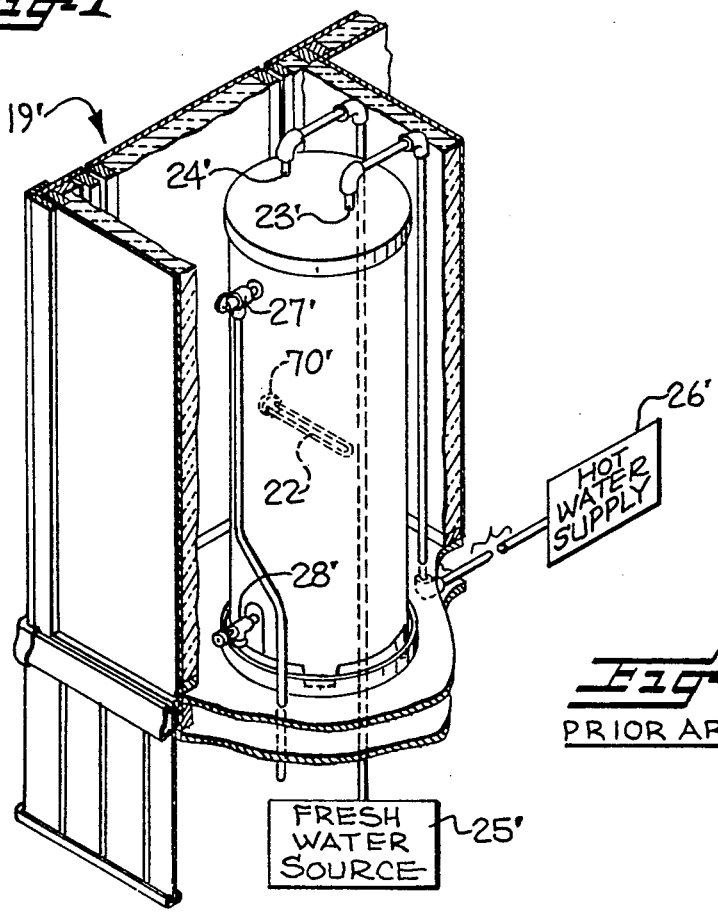
Fig. 2 PRIOR ART
FIG. 2 is a schematic view of a typical electric indoor water heater of the prior art.

FIG. 2 shows a portion of a mobile home 19' With a conventional electric water heater 21' positioned therein. The electric water heater 21' includes a conventional electric resistance type heating element 22 secured at a suitable fitting 70' on the eXterior of the tank. As would be readily understood by those skilled in the art, dual heating element heaters are also conventionally available. The conventional electric water heater 21' also includes an inlet 24' and outlet 23'. The inlet 24' is connected to a fresh water source 25'. The outlet 23' is connected to the interior plumbing of the mobile home 19' to provide the hot water supply thereto. The electric water heater 21' includes a conventional temperature and pressure (T & P) valve 27' and a conventional lower drain valve 28'.

Figure 3:
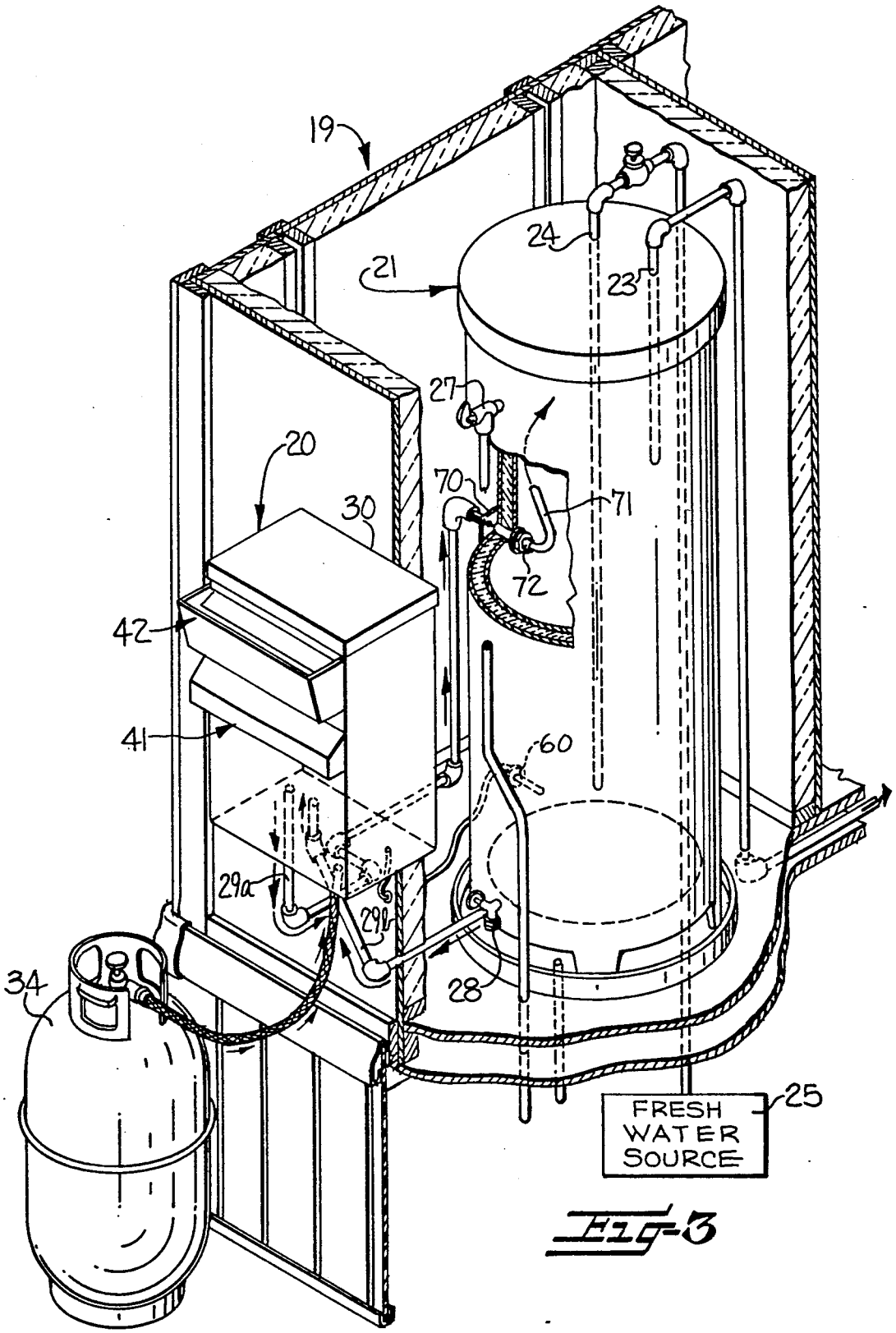
FIG. 3 is an enlarged schematic view of an electric water heater converted to operate with the gas water heater of the present invention and shown along the direction of arrow 3 of FIG. 1.
Figure 4:
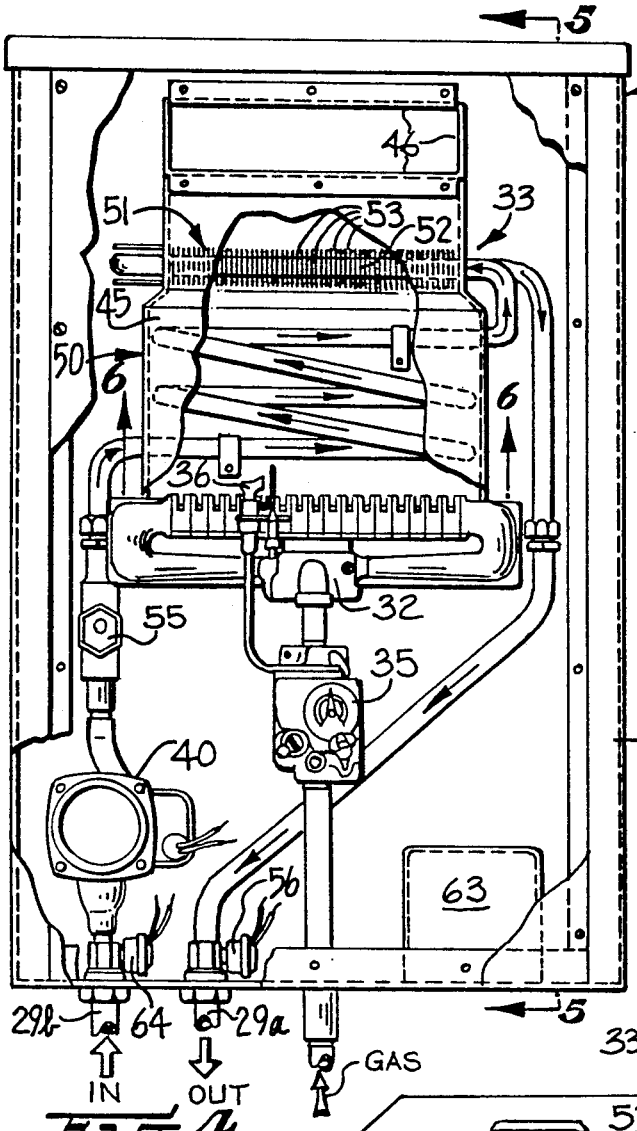
FIG. 4 is a cutaway front elevational view of the gas water heater as shown in FIG. 3.
Figure 5:
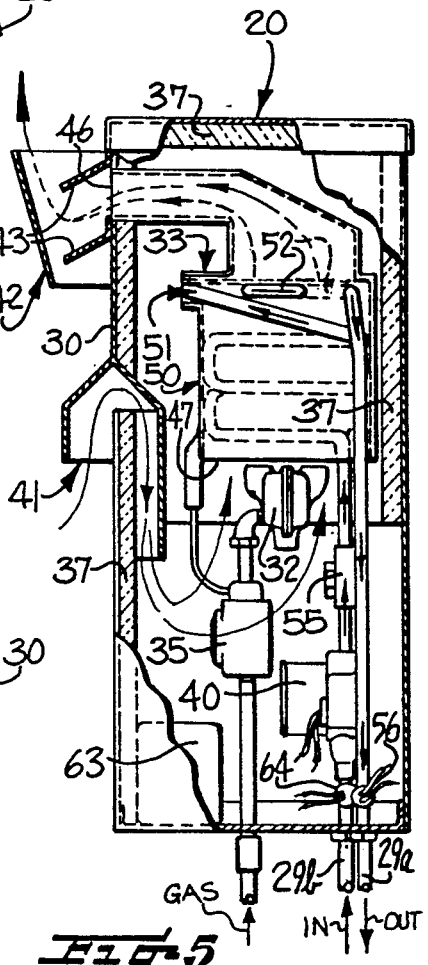
FIG. 5 is a side elevational view of the gas water heater along lines 5—5 as shown in FIG. 4.

As may be seen from FIG. 3, the gas heater 20 according to the present invention may be readily adapted to operate with a conventional electric water heater 21' as shown in FIG. 2. Stated in other words, the gas heater 20 may be used to convert an existing electric water heater 21' to operate from gas combusted outside of the mobile home 19 or other building. As explained above, gas offers significant fuel saVings over electricity in many parts of the country. In addition, since all of the gas connections and piping are outside of the building, the possibility of a leak causing an accumulation of gas within the building is virtually eliminated. This feature of the present invention is in sharp contrast to conventional gas appliances positioned within a building. Undesirable indoor air pollution is also avoided by combusting the gas outside of the building.

Referring to FIGS. 4–7, the basic operation of the gas heater 20 according to the present invention may be explained. The heater 20 includes a housing 30 preferably formed of sheet metal or other suitable material. The housing 30 may be readily mounted to an exterior wall of the building 19 by a pair of brackets 31. The brackets 31 proVide a clearance between the housing 30, which may at times reach relatively high temperatures, and the exterior of the building 19. Alternately, the heater 20 may be mounted on a concrete pad, not shown, positioned near the exterior of the buildinq 19.

The heater 20 includes a gas fired burner 32 and a heat exchanger 33 positioned adjacent thereto. The burner 32 is connected via control means 35 to a source of gas, such as the refillable propane container 34 shown in FIGS. 1 and 3. As would be readily understood by those having skill in the art, the gas heater 20 may also be connected to a utility gas distribution system, not shown, and provided with a gas fuel, such as natural gas, therefrom.

A standing pilot 36 may be provided adjacent the burner 32 to ignite the burner when the control means 35 calls upon the burner to provide heat to the heat exchanger 33. The standing pilot 36 also serves to provide an input of heat into the interior of the housing 3o to help prevent freezing of water within the heat exchanger 33 when the ambi®nt temperature outside the housing 3o falls close to or below freezing. As would be readily understood by those skilled in the art, other ignition devices may also be used in place of the standing pilot 36 including: direct spark ignition, hot surface ignition, or an intermittent ignition device which is a standing pilot ignited from a spark generator and which only operates while the burner 32 is in operation. In many locations, local codes may prohibit the use of a standing pilot 36 in which case one of the alternate burner ignition devices may be used.

Thermal insulation 37 is also preferably positioned within the interior of the housing 3o to reduce heat loss to the ambi®nt environment. The reduction of heat loss provides greater operating efficiency for the heater 2o and also helps to prevent freezing of water Within the heat exchanger 32 when the ambient temperature falls below freezing. The thermal insulation 37 also reduces the temperature rise of the exterior of the housing 3o so as to reduce the likelihood of burns caused by incidental contact with the relatively hot housing 3o caused by operation of the burner 32.

An electric pump 40 is positioned in fluid communication between the heat exchanger 33 and the indoor hot water storage tank 21. In the illustrated embodiment, the pump 40 is positioned within the housing 3o; however, as would be readily understood by those having skill in the art, the pump 40 may also be positioned within the building 19 or anywhere along the interconnecting lines **29*a*, 29*b* between the indoor hot water storage tank 21 and the heater 20**.

The housing 3o includes an air inlet 41 and an exhaust outlet 42 to circulate fresh air into the housing and to permit exhaust to be expelled from the housing by convective air currents. As shown in the illustrated embodiment, the outlet 42 may include a pair of baffles 43 to prevent the entry of water or debris into the housing 3o.

Figure 6:
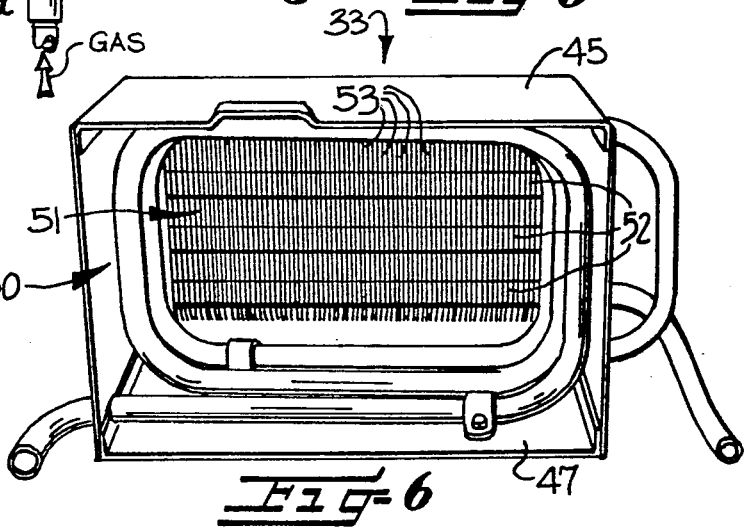
FIG. 6 is a bottom view of the heat exchanger along lines 6—6 as shown in FIG. 4.
Figure 7:
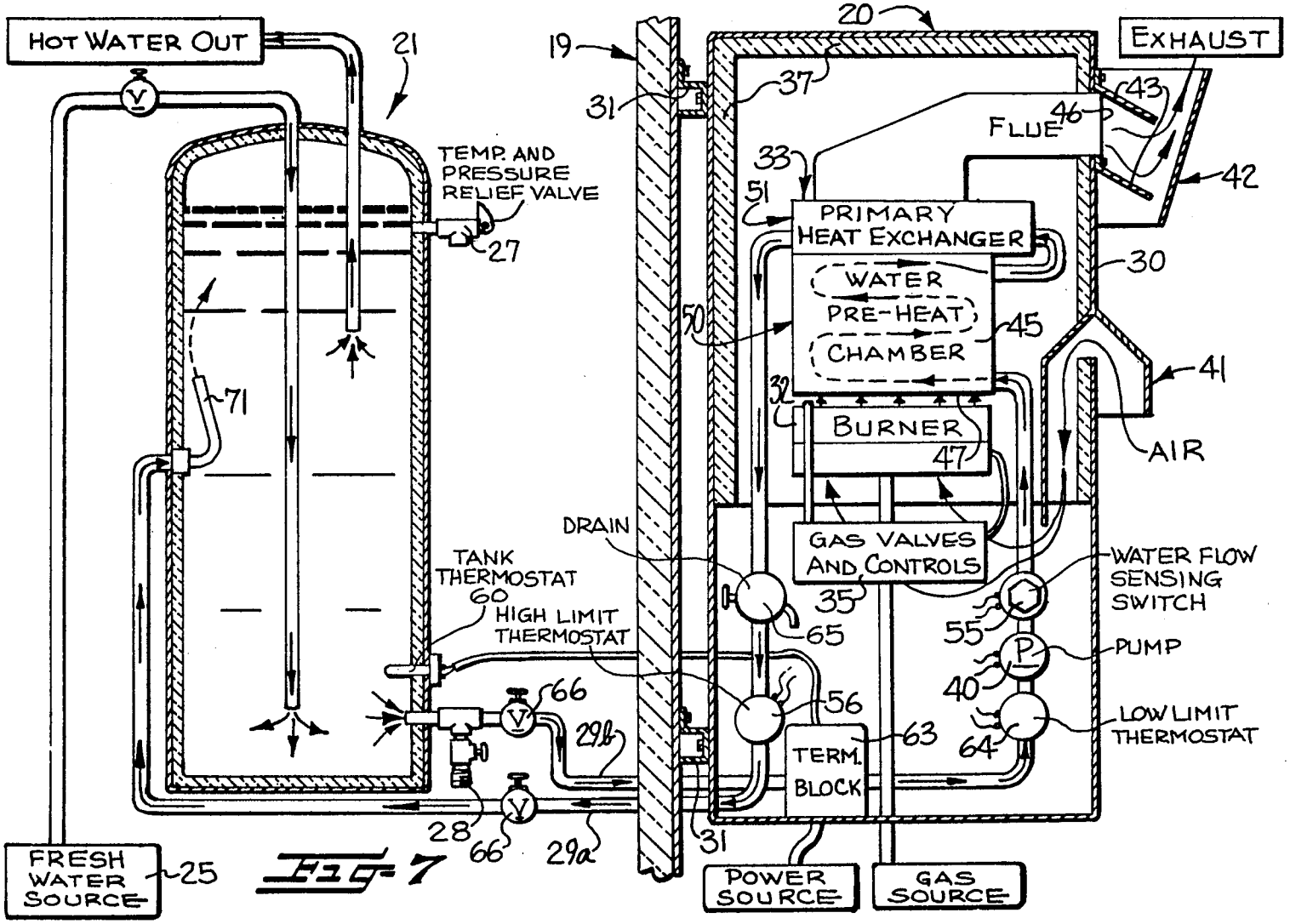
FIG. 7 is a schematic diagram of the gas water heater and indoor hot water storage tank as shown in FIG. 3.

The h®at exchanger 33 includes a chamber 45 having an upper opening 46 and a lower opening 47. The upper opening 46 is connected to the housing exhaust outlet 42. The lower opening 47 as shown in FIG. 6, is positioned adjacent to the burner 32. The heat exchanger 33 also includes a preheater 5o formed of tubing in a spiral arrangement positioned adjacent a lower portion of the chamber 45. The preheater 50 absorbs radiant heat from the burner flame. A primary heat exchanger 51 is positioned above the preheater 50 to intercept the flow of rising heated air from the burner 32 and transfer the heat to the water flowing through the primary heat exchanger 51. The primary heat exchanger 51 comprises a series of spaced heat transfer fins 53 and a serpentine arrangement of tubing 52 passing therethrough. The primary heat exchanger 51 and preheater 50 are connected together in fluid communication. The outer surfaces of the primary heat exchanger tubing, and the heat transfer fins 53 of the primary heat exchanger 51 preferably include a black coating thereon to increase absorption of heat from the burner 32. The tubing of the preheater 5o may also include a black coating on the outer surfaces thereof.

An important advantage of the heater 20 according to the present invention, is that the pump 40, burner 32, and heat exchanger 33 may be sized to provide a nearly continuous supply of hot water to a user for normal consumption. The pump 4o may be sized to provide a flow rate of 3-5 gallons per minute through the heat exchanger 33. Also, the heat exchanger 33 and burner 32 may be sized to provide a temperature boost to the water delivered from the heater 20 of no less than about 20° F. The pump 40, interconnecting lines 29*a*, 29*b*, heat exchanger 33, and burner 32 may typically be sized to satisfactorily meet design specifications for a flow rate and temperature boost for separation distances, between the heater 2o and the indoor hot water storage tank 21, of up to 50 feet or more.

The tubing of the heat exchanger 33 may also have a relatively small fluid capacity of no more than a small fraction of the total capacity of the indoor hot water storage tank 21. In a preferred embodiment Of the heater 20 for a mobile home or house, the capacity of the heat exchanger 33 may be less than about a quart. An indoor storage tank may have a capacity of about 20-100 gallons, with a typical capacity being from about 30-80 gallons.

To prevent damage to the heat exchanger 33, a flow sensing switch 55 is positioned in the water line. As shown in the electrical schematic diagram of FIG. 11, the flow sensing switch 55 will prevent operation of the gas control valve 35 until there is sufficient water flow through the heat exchanger 33 to cool same. Also referring to FIG. 11, the heater control circuit includes a high temperature switch 56 to shut off the gas control valve 35 if the temperature in the heat exchanger 33 exceeds a predetermined temperature near the boiling point of water. The high temperature thermostat 56 may be positioned adjacent the outlet tubing of the heater 2o or may positioned more closely to the heat exchanger 33. If the water in the heat exchanger 33 is overheated to steam, insufficient cooling of the heat exchanger 33 may cause melting of the heat exchanger unless the burner 32 is shut off. The high temperature thermostat 56 may be a thermodisk sensor, an immersion type sensor, or any other type of temperature sensor or switch as would be readily understood by those skilled in the art.

Figure 11:
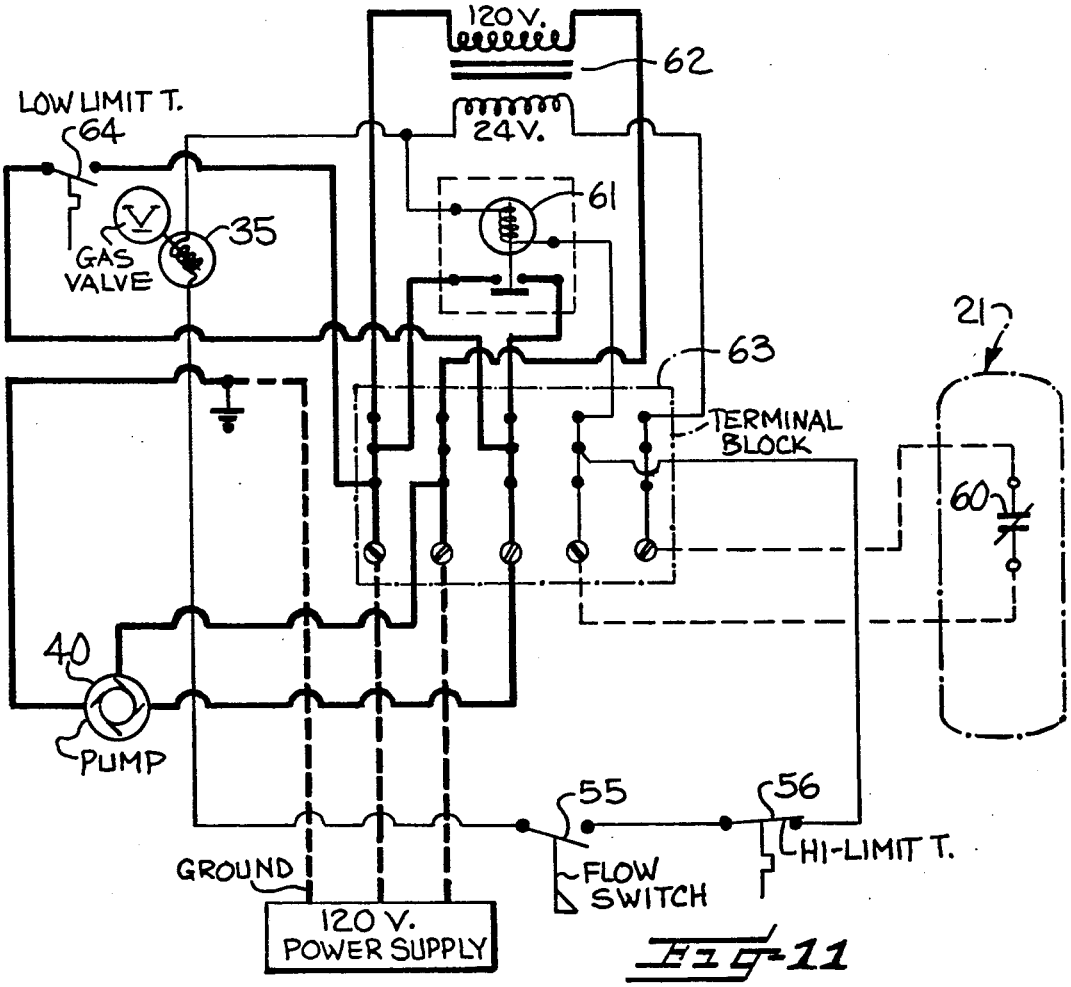
FIG. 11 is an electrical schematic diagram of the gas water heater control circuit according to the present invention.

The electrical control of the pump 40 and the gas control valve 35 may be integrated with a conventional thermostat 60 positioned in the indoor storage tank 21, and an associated a 120 VAC to 24 VAC transformer 62 and relay 61 for switching the 120 VAC power as shown in FIG. 11. Many of the electrical interconnections for the heater 20 may be conveniently made at an interconnecting terminal block 63 positioned within the housing 3o. As would be readily understood by those skilled in the art, a conventional electric water heater 21' includes a thermostat 60' and, thus, may be readily adapted to operate With the gas heater 2o according to another aspect of the present invention.

A significant problem addressed by the present invention is the prevention of freezing of water that is circulated outside of the building or mobile home 19 as illustrated in FIGS. 1 and 3. The heat exchanger 33 is particularly susceptible to damage as a result of water freezing therein. To prevent freezing, the heater 2o includes a low temperature thermostat 64 that is positioned within the housing 3o to measure the temperature of water in the heat exchanger 33. As shown in the schematic electrical control diagram of FIG. 11, the low temperature thermostat 64 will close and initiate the pump 40 if the temperature falls below a predetermined temperature, such as about 43° F. or no more than about 10° above freezing. Closure of the low temperature thermostat 64 will cause relatively warm water from the indoor water storage tank 21 to circulate through the interconnecting plumbing and through the heat exchanger 33 to prevent freezing of water in the heat exchanger. If electrical power is lost for example, or the building will be unoccupied for an extended period, water may be drained from the heater 2o through valve 65. Cutoff valves 66, including drains, may also be provided within the building 19 to facilitate installation or draining of the heater 20 and associated plumbing interconnections 29*a*, 29*b*. In addition, the interconnecting lines 29*a*, 29*b* may be covered by suitable thermal insulation to help retain heat and prevent freezing of water therein.

A large portion of the potential commercial market for a gas heater 2o is likely to be to retrofit existing electric water heaters to operate from a cheaper gas fuel that is combusted outside of the building or house. Accordingly, another aspect of the present invention is a method for converting an existing electric water heater 21' (FIG. 2) to operate with the gas heater 2o described above. First, the Conventional electric heating element 22, or elements, is disabled. The gas heater 2o described above may then be positioned outside of the building or mobile home 19 including the pump 40 in fluid communication between the indoor hot water storage tank 21 and the heat exchanger 33. The heater 2o may then be operated as described above.

The heater 20 may be "winterized," that is, protected against water freezing damage, by adding heat to the heat exchanger 33 when the burner 32 is not being called upon to operate to heat water responsive to the indoor storage tank thermostat 6o. For example, the heater 20 may be heated by operating a standing pilot 36 Or by operating the pump 4o responsive to a low temperature thermostat sensing the temperature of the water in the heat exchanger 33 falling below a predetermined temperature as also described above.

The heating element 22 of the existing electric water heater 21' may be disconnected from the electrical supply or may be cmopletely removed, thereby permitting access to the fitting 70 to mount a return tube 71 into the tank 21 as shown in FIGS. 3 and 8-10. The return tube 71 is connected to the outlet of the heat exchanger 33 to return heated water to the indoor hot water storage tank 21. As shown in the illustrated embodfiment, the return tube 71 may be positioned in an upright fashion in the generally cylindrical storage tank 21 so that the heated water mixes with the relatively warm water in the upper regions of the tank 21. The return tube 71 may preferably include a rotatable coupling 72 adapted for connection to the electrical heating element fitting 70.

Figure 8:
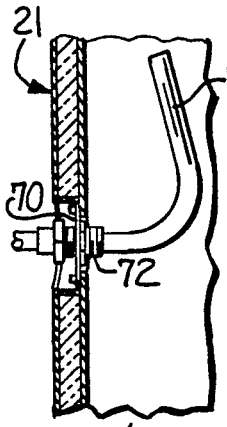
FIGS. 8-10 are partial schematic views of a return tube according to the present invention mounted in position in the interior of the hot water storage tank as shown in FIG. 3.
Figure 9:
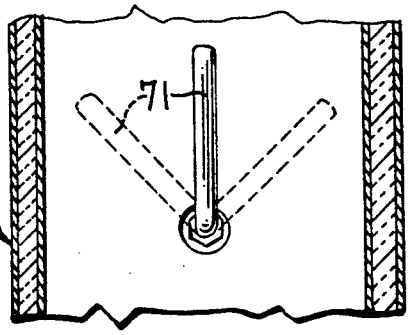
Figure 10:
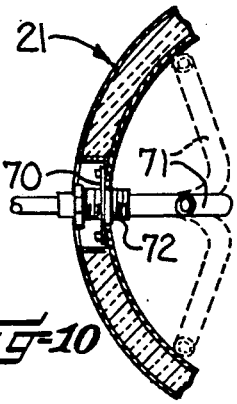

As best shown in FIGS. 8-10, the return tube 71 is a generally L-shaped tube with an acute angle formed between the two legs of about 75°. The acute angle and length of the return tube 71 permit the tube to pivot on the rotatable coupling 73 yet remain in a generally upright orientation by contacting the cylindrically shaped interior wall of the indoor storage tank 21.

As would be readily understood by those skilled in the art, a conventional electric water heater may have a heater element fitting in the upper region of the tank, not shown, in which case the return tube 71 would be positioned in an inverted position with the water being discharged in a downward direction to prevent the heated water from being presented immediately to the tank hot water outlet 23. In yet anoter embodiment of the ivnention, the heat exchanger outlet may be coupled to the storage tank 21 through a conventional temperature and pressure relief valve 27 fitting. As would be readily understood by those skilled in the art, there are other possibilities for connecting the outlet of the heat exchanger 33 in fluid communication with the upper regions of the indoor hot water storage tank 21.

The inlet of the heat exchanger 33 is connected in fluid communication with the lower regions of the indoor hot water storage tank 21. As shown in the illustrated embodiment in FIGS. 3 and 7, the connection to the indoor storage tank 21 may be made by replacement of the conventional lower drain valve 28' with a new drain valve 28 that permits water to be drained from the storage tank 21 in a conventional fashion and also provides a connection to the lower regions of the storage tank 21.

Figure 12:
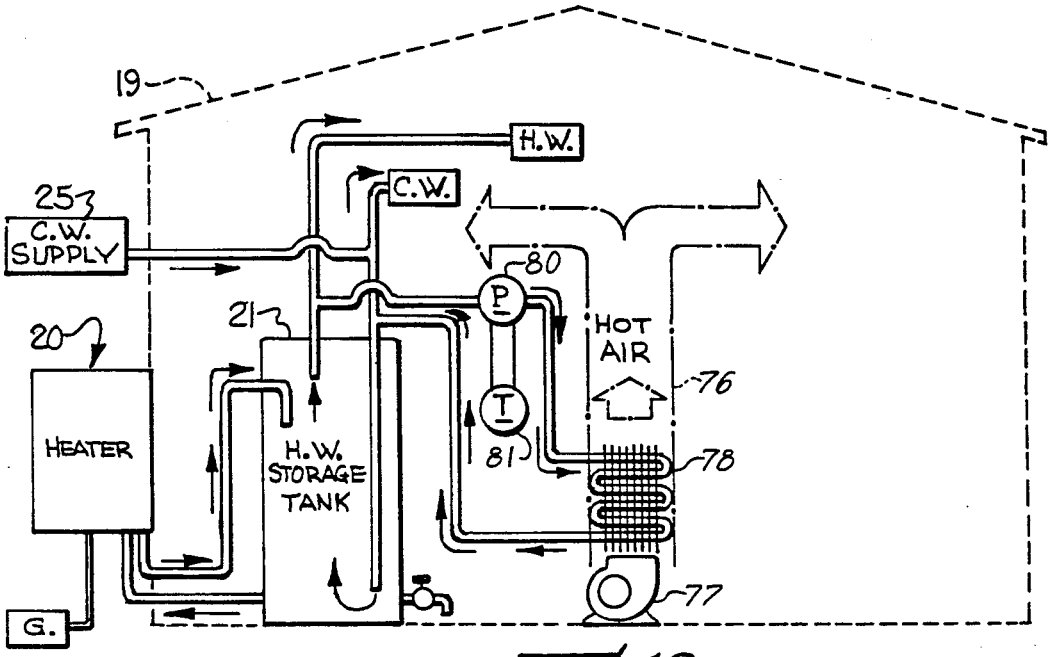
FIG. 12 is a schematic diagram of the gas water heater and indoor storage tank unsed for space heating of the building according to one embodimetn of the invnetion.
Figure 13:
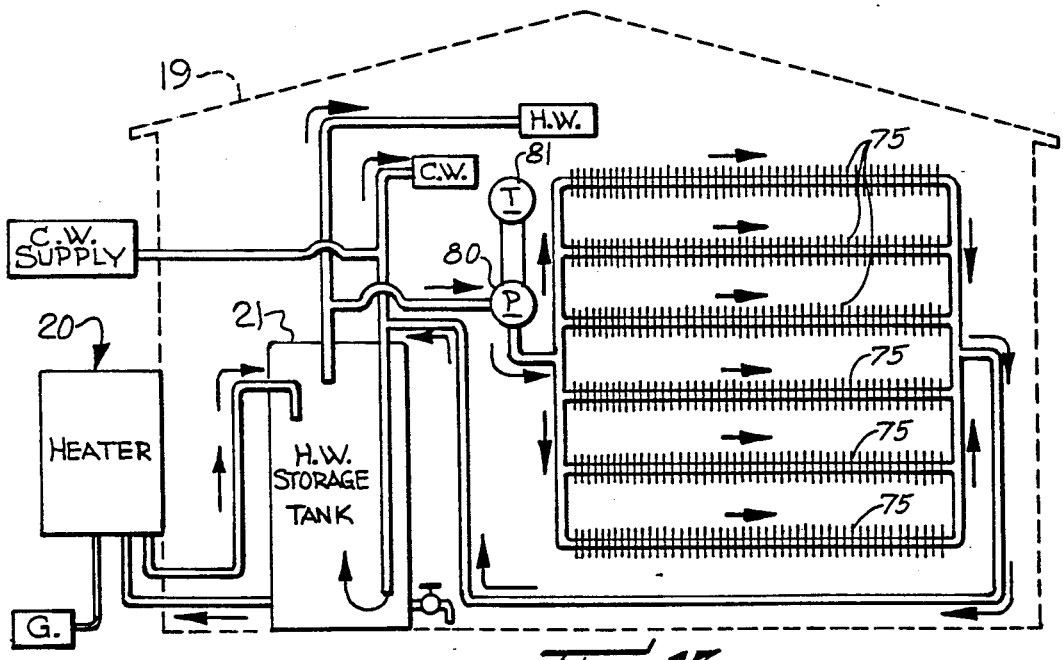
FIG. 13 is a schematic diagram of the gas water heater and indoor storage tank used for space heating of teh building according to another emboidment of the invnetion.

The gas heater 20, acCording to another aspect of the present invention, may be used to supply heat for space heating of the building 19 as shown in FIGS. 12 and 13. For a space heating system that circulates hot water to radiant baseboard heating units (FIG. 13), water may be circulated from the indoor hot storage tank 21 to the baseboard units. As shown in FIG. 12 for a building 19 having an existing heating or cooling system, inculding air ducts 76 and a fan 77, a heat exchanger 78 may be connected in fluid communication with the indoor hot water storage tank 21 and positioned in a duct of the heating system. The existing space heating source, such as a heat pump for example, may be disconnected.

Referring now to FIG. 12, a pump 80 may circulate the heated water from the indoor water storage tank 21 through the heat exchanger 78 in the duct 76 as needed. Air is forced over the heat exchanger 78 by the fan 77 and delivered throughout the building 19. As the heat exchanger 78 draws heat from the indoor hot water storage tank 21, the temperature of the water in the storage tank will drop. When the temperature of water in the storage tank 21 falls below the predetermined threshold as described above, the gas heater 20 will operate and add heat to the water in the storage tank 21. The pump 80 and the thermostat 81 as shown in the embodiment of FIG. 12 operate in a similar fashion. The components of the heater 20, such as the pump 40, heat exchanger 33, and burner 32 may be appropriately sized to supply any additional heating capacity that may be required for space heating. Thus, the gas heater 20 may be used to provide both a hot water supply and space heating for the building 19. This additional capability will permit conversion of all-electric homes, for example, to operate from gas for an even greater portion of their energy requirements.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus for providing a hot water supply for a building, said apparatus compirsing:

a hot water storage tank positioned within the buld-ing;

a first thermostat positioend in siad hot water storage tank;

a housing mounted outside of teh building;

a gas-fueled burner positioned within siad housing and including means for controlling gas flow thereto;

a heat exchanger positioned within siad housing adjacent said burner, siad heta exchanger having an inlet and an outlet connected in fluid communication with siad hot water storage tnak;

a pump connected in fluid communication with said heat exchanger for circulating ater from siad hot water storage tank through siad heat exchanger and back into siad storage tank;

heater control means operatively conencted to siad first thermostat, siad pump and siad gas flow control measn for activating siad pump and siad burner so that water flows through and is heated in siad heat exchanger when the temperature of the water in siad hot water storage tank falls below a first predetermined temperature; and a second thermostat positioend within siadh ousing, said second thermostat operatively connected to siad pump so as to activate same when the temperature of water within said heat exchanger falls below a second predetermined temperature to thereby circulate relatively warm water from siad hot water storage tank through siad heat exchanger to thereby prevent freezing of water therein.

2. The apparatus according to claim 1 further comprising a third thermostat positioned within said housing, and wherein said third thermostat is operatively connected to said burner control means for shutting off the flow of gas to said burner when the temperature of water in said heat exchanger exceeds a third predetermined temperature to thereby protect said heat exchanger from damage, such as when the water flowing therethrough is overheated and converted to steam.

3. The apparatus according to claim 1 wherein said second predetermined temperature is no more than about 10° F. above freezing.

4. The apparatus according to claim 1 further comprising a flow detector positioned in fluid communication with said heat exchanger, and wherein said flow detector is operatively connected to said control means for proving water flow through said heat exchanger prior to activating said burner to thereby prevent damage to said heat exchanger caused by operation of said burner without a sufficient water flow rate through said heat exchanger to cool same.

5. The apparatus according to claim 1 further comprising a standing pilot adjacent said burner for igniting said burner and for providing heat to said heat exchanger to prevent freezing of water therein when the ambient temperature falls below freezing.

6. The apparatus according to claim 1 wherein said pump provides a relatively high flow of water of about 3 to 5 gallons per minute, and wherein said burner and said heat exchanger provide a temperature boost of no less than about 20° F. to water flowing through said heat exchanger so that a nearly continuous supply of hot water is provided during normal consumption.

7. The apparatus of claim 1 wherein said heat exchanger comprises tubing having a relatively small fluid capacity of no more than a small fraction of the total capacity of said hot water storage tank.

8. The apparatus according to claim 1 wherein said storage tank includes at least one fitting adapted for retaining an electric heating element therein, and wherein said outlet of said heat exchanger is connected in fluid communication with said hot water storage tank through said fitting.

9. The apparatus according to claim 1 further comprising thermal insulation positioned adjacent the interior surface of said housing to reduce heat loss to the ambient air surrounding said housing to thereby increase operating efficiency and reduce the heat required to prevent freezing of water in said heat exchanger when the ambient temperature falls below freezing.

10. An apparatus for providing a hot water supply for a building, said apparatus comprsing:

an indoor hot water storage tank positoiend within the building;

a thermostat positoend in said hot water storage tank;

a housing mounted outside of the building, siad housing incuding an exhaust opening and an air intake opening formed therin;

a gas-fueled burner positioned within siad housing and includnig means for controlling gas flow thereto;

a heat exchanger positioned within siad housing, said heat exchanger having an inlet and an outlet beign connected in fluid commucnation with siad water storage tank, said heat exchanger comrising:

a chamber having an upper opening and a lower opening, siad upper opening communicating with said exchaust opening of siad housing, and said lower opening being positioned ajdacnet siad burner;

a preheater comrising tubing formed in a spiral arrangement adjacent a lowr portion of siad camber for absorbing radiant heat from siad burner; and a primary heat exchanger postioend above said preheater and cmoprising a series of parallel spaced-apart heat transfer fins and a serpentine arrangement of tubing passing therethrough, siad serpentine tubing of siad parimary heat exchangr bineg in fulid communication with siad preheater tubing;

a pump conected in fluid commucnation with said heat exchangr for ciraulting water rom siad hot water storage tnak through siad heat excanger and back into siad storage tank; and heater control mnas opratively connected to said thermostat, said pump and siad gas flow control means for actvating siad pump and said burner so that water flows through and is heated in siad heat exchanger when the temperature of the water in siad hot water storage tank falls below a predetermined temperature.

11. The apparatus accoring to claim 10 wherein the surfaces of siad heat transfer fins and said serpentine tubing of siad primary heat exchanger include a black coating thereon to increase absorption of heat from said burner.

12. The apparatus according to claim 10 further comprising a second thermostat positioned within said housing, said second thermostat operatively connected to said pump so as to activate same when the temperature of water within said heat exchanger falls below a temperature of no more than about 10° F. above freezing to thereby circulate relatively warm water from said hot water storage tank through said heat exchanger to prevent freezing of water therein.

13. The apparatus according to claim 12 further comprising a third thermostat positioned within said housing, and wherein said third thermostat is operatively connected to said burner control means for shutting off the flow of gas to said burner when the temperature of water in said heat exchanger exceeds a third predetermined temperature to thereby protect said heat exchanger from damage, such as when the water flowing therethrough is overheated and converted to steam.

14. The apparatus according to claim 10 further comprising a flow detector positioned in fluid communication with said heat exchanger, and wherein said flow detector is operatively connected to said control means for proving water flow through said heat exchanger prior to activating said burner to thereby prevent damage to said heat exchanger caused by operation of said burner without a sufficient water flow rate through said heat exchanger to cool same.

15. The apparatus according to claim 10 further comprising a standing pilot adjacent said burner for igniting said burner and for providing heat to said heat exchanger to prevent freezing of water therein.

16. The apparatus according to claim 10 wherein said pump provides a relatively high flow of water of about 3 to 5 gallons per minute, and wherein said burner and said heat exchanger provide a temperature boost of no less than about 20° F. to water flowing through said heat exchanger so that a nearly continuous supply of hot water is provided during normal consumption.

17. The apparatus of claim 10 wherein said preheater tubing and said primary heat exchanger tubing having a combined relatively small fluid capacity of no more than a small fraction of the total capacity of said hot water storage tank.

18. The apparatus according to claim 10 wherein said hot water storage tank includes at least one fitting adapted for retaining an electric heating element therein, and wherein said outlet of said heat exchanger is connected in fluid communication with said storage tank through said fitting 19. The apparatus according to claim 10 further comprising thermal insulation positioned adjacent the interior surface of said housing to reduce heat loss to the ambient air surrounding said housing thereby increasing operating efficiency and reducing the heat required to prevent freezing of water in said heat exchanger when the ambient temperature falls below freezing.

20. An apparatus for providing a hot water supply for a building, said apparatus comprsing:

a generally cylindrical hot water storage tank positioned within the building, said tank having an upper fitting of the type typically used for receiving an electrical heating element therein;

a return tube posiionted within siad hot water storage tank and connectd at siad upper fitting thereo, said return tue being substantially L-shaped to direct water flowing into said tank to mix with the relatively hot water in the upper regions of siad hot water stoage tank;

a thermostat positioned in siad hot water storage tank;

a housing mounted outside of teh building;

a gas-fueled burner positioned within siad housing and including means for controlling gas flow thereto;

a heat exchanger positioned within siad ousing and including means for controlling gas flow thereto;

a heat exchanger positioned adjacent siad burner and positoiend within siad ousng, siad heat exchanger having an inlet in fluid communication with loer regions of siad hot water storage tank so as to permit drawing off of rleatively cool water therefrom, said heat exchanger having an outlet in fulid communication with the upper regions of siad tank through siad return tube;

a pump in fluid communication with siad heat exchagner for circulating water from said hot water storage tank through siad heat exchanger and back into said storage tank; and heater control mnas opratively connected to said thermostat, said pump and siad gas flow control means for actvating siad pump and said burner so that water flows through and is heated in siad heat exchanger when the temperature of the water in siad hot water storage tank falls below a predetermined temperature.

21. The apparatus according to claim 20 wherein siad generally L-shaped return tube includes a rotatable coupling mounted on an end thereof, and wherein said rotatable coupling is secured to said fitting of said storage tank.

22. The apparatus according to claim 21 wherein said water storage tank has an upright generally cylindrical shape, and wherein said return tube has an angle of about 75° so that an end of said return tube opposite said coupler end remains in a generally upright orientation within said storage tank by contact with the inner wall of the cylindrical storage tank.

23. The apparatus according to claim 20 further comprising a second thermostat positioned within said housing, said second thermostat operatively connected to said pump so as to activate same when the temperature of water within said heat exchanger falls below a temperature of no more than about 10° F. above freezing to thereby circulate relatively warm water from said water storage tank through said heat exchanger to prevent freezing of water therein.

24. The apparatus according to claim 23 further comprising a third thermostat positioned within said housing, and wherein said third thermostat is operatively connected to said burner control means for shutting off the flow of gas to said burner when the temperature of water in said heat exchanger exceeds a third predetermined temperature to thereby protect said heat exchanger from damage, such as when the water flowing therethrough is overheated and converted to steam.

25. The apparatus according to claim 20 further comprising a flow detector positioned in fluid communication with said heat exchanger, and wherein said flow detector is operatively connected to said control means for proving water flow through said heat exchanger prior to activating said burner to thereby prevent damage to said heat exchanger caused by operation of said burner without a sufficient water flow rate through said heat exchanger to cool same.

26. The apparatus according to claim 20 further comprising a standing pilot adjacent said burner for igniting said burner and for providing heat to said heat exchanger to prevent freezing of water therein.

27. The apparatus according to claim 20 wherein said pump provides a relatively high flow of water of about 3 to 5 gallons per minute, and wherein said burner and said heat exchanger provide a temperature boost of no less than about 20° F. to water flowing through said heat exchanger so that a nearly continuous supply of hot water is provided during normal consumption.

28. The apparatus of claim 20 wherein said heat exchanger comprises tubing having a relatively small fluid capacity of no more than a small fraction of the total capacity of said hot water storage tank.

29. The apparatus according to claim 20 further comprising thermal insulation positioned adjacent the interior surface of said housing to reduce heat loss to the ambient air surrounding said housing thereby increasing operating efficiency and reducing the heat required to prevent freezing of water in said heat exchanger when the ambient temperature falls below freezing.

30. A method of converting an electric water heater located inside a building to operate from gas combusted outdoors, the indoor electric water heater including a hot water storage tank with an electric heating element therein and a water temperature responsive thermostat coupled thereto, said method comprising the steps of:

disabling the electrical heating element of the indoor water heater;

positioning a gas-fueled burner and associated heat exchanger outside the building;

connecting the heat exchanger in fluid communication with the indoor hot water storage tank;

connecting a pump in fluid communication between the indoor hot water storage tank and the outdoor heat exchanger; and providing a control for operation of the pump and gas burner when the indoor tank thermostat senses the temperature of the water in the indoor hot water storage tank falling below a predetermined temperature as when heated water is drawn off causing cold water to enter the storage tank.

31. The method of claim 30 further including the step of proving water flow through the heat exchanger before activating the gas burner to thereby prevent damage to the heat exchanger caused by operation of the burner without a sufficient water flow rate through the heat exchanger to cool same.

32. The method of claim 30 further including the steps of sensing the temperature of water in the heat exchanger and de-activating the gas burner when the sensed temperature exceeds a predetermined temperature to thereby protect the heat exchanger from damage, such as when the water flowing therethrough is overheated and converted to steam.

33. The method of claim 30 wherein the indoor hot water storage tank has a fitting for receipt therein of the electrical heating element, wherein the step of disabling the heating element includes the step of removing the heating element from the heating element fitting; and wherein the step of connecting the heat exchanger in fluid communication with the indoor hot water storage tank includes the step of positioning a return tube, connected to the outlet of the heat exchanger, in the heating element fitting.

34. The method of claim 30 wherein the indoor hot water storage tank includes a drain valve adjacent the lower regions thereof, and wherein the step of connecting the heat exchanger in fluid communication with the indoor hot water storage tank includes the step of connecting the inlet of the heat exchanger in fluid communication with the indoor hot water storage tank adjacent the drain valve.

35. A method of converting an electric water heater located inside a building to operate from gas combusted outdoors, the indoor electric water heater including a hot water storage tank with an electric heating element therein and a water temperature responsive thermostat coupled thereto, said method comprising the steps of:

disabling the electrical heating element of the indoor water heater;

positioning a gas-fueled burner and associated heat exchanger outside the building;

connecting the heat exchanger in fluid communication with the indoor hot water storage tank;

connecting a pump in fluid communication between the indoor water storage tank and the outdoor heat exchanger;

providing a control for operation of the pump and gas burner when the indoor tank thermostat senses the temperature of the water in the indoor hot water storage tank falling below a predetermined temperature as when heated water is drawn off causing cold water to enter the storage tank; and adding heat to the heat exchanger when the gas burner is not operating so that water in the heat exchanger is prevented from freezing and damaging the heat exchanger, such as during winter when the ambient temperature drops below freezing and while the water temperature in the indoor water storage tank is sufficiently high so as not to require heating.

36. The method of claim 35 wherein the step of adding heat to the outdoor heat exchanger includes the steps of sensing the temperature of water in the heat exchanger, and operating the pump to circulate relatively warm water from the indoor hot water storage tank through the heat exchanger responsive to the sensed temperature of the water in the heat exchanger falling below a predetermined temperature.

37. The method of claim 35 wherein the step of adding heat to the outdoor heat exchanger includes the step of continuously operating a gas pilot adjacent the outdoor heat exchanger.

38. The method of claim 35 further including the step of proving water flow through the heat exchanger before activating the gas burner to thereby prevent damage to the heat exchanger caused by operation of the burner without a sufficient water flow rate through the heat exchanger to cool same.

39. The method of claim 35 further including the steps of sensing the temperature of the water in the heat exchanger and de-activating the gas burner when the sensed temperature exceeds a predetermined temperature to thereby protect the heat exchanger from damage, such as when the water flowing therethrough is overheated and converted to steam.

40. The method of claim 35 wherein the indoor hot water storage tank has a fitting for receipt therein of the electrical heating element, wherein the step of disabling the heating element includes the step of removing the heating element from the heating element fitting; and wherein the step of connecting the heat exchanger in fluid communication with the indoor hot water storage tank includes the step of positioning a return tube, connected to the outlet of the heat exchanger, in the heating element fitting.

41. The method of claim 35 wherein the indoor hot water storage tank includes a drain valve adjacent the lower regions thereof, and wherein the step of connecting the heat exchanger in fluid communication with the indoor hot water storage tank includes the step of connecting the inlet of the heat exchanger in fluid communication with the indoor hot water storage tank adjacent the drain valve.

42. An apparatus for provdiing a hot water supply and space heating for abuilding, siad apparatus comprising:

a hot water storage tank positioned within the bulding;

a first thermostat positioend in siad hot water storage tank;

a housing mounted outside of teh building;

a gas-fueled burner positioned within siad housing and including means for controlling gas flow thereto;

a heat exchanger positioned within siad housing adjacent said burner, siad heta exchanger having an inlet and an outlet connected in fluid communication with siad hot water storage tnak;

a pump connected in fluid communication with said heat exchanger for circulating ater from siad hot water storage tank through siad heat exchanger and back into siad storage tank;

heater control means operatively conencted to siad first thermostat, siad pump and siad gas flow control measn for activating siad pump and siad burner so that water flows through and is heated in siad heat exchanger when the temperature of the water in siad hot water storage tank falls below a first predetermined temperature;

a heat exchanger positioned within the building; and measn connected in fluid communiation with siad heat exchanger within the building for circulating water from said hot water stroage tank therethrough and back into siad stroage tank for thereby supplying heat for space heating of the buliding.

43. An apparatus to claim 42 wherein siad means connected in fluid communication with siad heat exchanger within the building for circulating water from said hot water storage tank therethrough comprises a second pump for circulating water from said hot water storage tank through said heat exchanger within the building and back into said storage tnak.

44. An apparatus according to claim 42 further comprising a second thermostat positiond within siad housing, said second thermostat operatively conected to siad pump so as to activate same when the temperature of water within said heat exchanger falls below a second predetermined temperature to thereby circulate relatively warm water from siad hot water stoage tank through siad heat exchanger to thereby prevent feezing of water therin.

45. An apparatus for providing a hot water supply and space heating for a buiding, siad apparatus comprisign:

a hot water storage tank positioned within the bulding;

a first thermostat positioend in siad hot water storage tank;

a housing mounted outside of teh building;

a gas-fueled burner positioned within siad housing and including means for controlling gas flow thereto;

a heat exchanger positioned within siad housing adjacent said burner, siad heta exchanger having an inlet and an outlet connected in fluid communication with siad hot water storage tnak;

a pump connected in fluid communication with said heat exchanger for circulating ater from siad hot water storage tank through siad heat exchanger and back into siad storage tank;

heater control means operatively conencted to siad first thermostat, siad pump and siad gas flow control measn for activating siad pump and siad burner so that water flows through and is heated in siad heat exchanger when the temperature of the water in siad hot water storage tank falls below a first predetermined temperature; and a second thermostat positioend within siadh ousing, said second thermostat operatively connected to siad pump so as to activate same when the temperature of water within said heat exchanger falls below a second predetermined temperature to thereby circulate relatively warm water from siad hot water storage tank through siad heat exchanger to thereby prevent freezing of water therein;

a heat exchanger positioned within the building; and measn iclduing a secodn pump connected in fluid comunication with siad heat exchanger within the building for circulatign water from siad hot water storage tank therethrough and back into siad storage tank for thereby supplying heat for space heating of the building.

* * * * *

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 2, Line 9, delete "INVNETION" and insert --INVENTION--.

Col. 4, Line 6, delete "invetion" and insert --invention--.

Col. 4, Line 6, delete "abilty" and insert --ability--.

Col. 4, Line 8, delete "buliding" and insert --building--.

Col. 4, Line 11, delete "sorage" and insert --storage--.

Col. 4, Line 13, delete "e4xchanger" and insert --exchanger--.

Col. 4, Line 14, delete "ocnnected" and insert --connected--.

Col. 4, Line 14, delete "fulid" and insert --fluid--.

Col. 4, Line 21, delete "returend" and insert --returned--.

Col. 4, Line 21, delete "teh" and insert --the--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 4, Line 21, delete "stroage" and insert --storage--.

Col. 4, Line 50, delete "unsed" and insert --used--.

Col. 4, Line 51, delete "embodimetn" and insert --embodiment--.

Col. 4, Line 52, delete "invnetion" and insert --invention--.

Col. 4, Line 55, delete "teh" and insert --the--.

Col. 4, Line 55, delete "emboidment" and insert --embodiment--.

Col. 4, Line 59, delete "EMBOIDMENT" and insert --EMBODIMENT--.

Col. 5, Line 18, delete "With" and insert --with--.

Col. 5, Line 22, delete "eXterior" and insert --exterior--.

Col. 5, Line 40, delete "saVings" and insert --savings--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 5, Line 55, delete "proVide" and insert --provide--.

Col. 6, Line 5, delete "3o" and insert --30--.

Col. 6, Line 7, delete "ambi®nt" and insert --ambient--.

Col. 6, Line 8, delete "3o" and insert --30--.

Col. 6, Line 19, delete "3o" and insert --30--.

Col. 6, Line 20, delete "ambi®nt" and insert --ambient--.

Col. 6, Line 22, delete "2o" and insert --20--.

Col. 6, Line 22, delete "Within" and insert --within--.

Col. 6, Line 26, delete "3o" and insert --30--.

Col. 6, Line 27, delete "3o" and insert --30--.

Col. 6, Line 32, delete "3o" and insert --30--.

Col. 6, Line 38, delete "3o" and insert --30--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 6, Line 43, delete "3o" and insert --30--.

Col. 6, Line 44, delete "h®at" and insert --heat--.

Col. 6, Line 49, delete "5o" and insert --50--.

Col. 6, Line 65, delete "5o" and insert --50--.

Col. 7, Line 3, delete "4o" and insert --40--.

Col. 7, Line 12, delete "2o" and insert --20--.

Col. 7, Line 17, delete "Of" and insert --of--.

Col. 7, Line 35, delete "2o" and insert --20--.

Col. 7, Line 52, delete "3o" and insert --30--.

Col. 7, Line 55, delete "With" and insert --with--.

Col. 7, Line 55, delete "2o" and insert --20--.

Col. 7, Line 62, delete "2o" and insert --20--.

Col. 7, Line 64, delete "3o" and insert --30--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 8, Line 9, delete "2o" and insert --20--.

Col. 8, Line 18, delete "2o" and insert --20--.

Col. 8, Line 23, delete "2o" and insert --20--.

Col. 8, Line 24, delete "Conventional" and insert --conventional--.

Col. 8, Line 25, delete "2o" and insert --20--.

Col. 8, Line 29, delete "2o" and insert --20--.

Col. 8, Line 35, delete "6o" and insert --60--.

Col. 8, Line 37, delete "Or" and insert --or--.

Col. 8, Line 37, delete "4o" and insert --40--.

Col. 8, Line 43, delete "cmopletely" and insert --completely--.

Col. 8, Line 48, delete "embodfiment" and insert --embodiment--.

Col. 9, Line 1, delete "anoter" and insert --another--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 9, Line 2, delete "ivnention" and insert --invention--.

Col. 9, Line 19, delete "acCording" and insert --according--.

Col. 9, Line 25, after "FIG. 12" insert --,--.

Col. 9, Line 32, after "pump 80" insert --and a thermostat 81--.

Col. 9, Line 64, delete "compirsing" and insert --comprising--.

Col. 9, Line 65, delete "buld-" and insert -- build- --.

Col. 9, Line 67, delete "positioend" and insert --positioned--.

Col. 9, Line 67, delete "siad" and insert --said--.

Col. 10, Line 1, delete "teh" and insert --the--.

Col. 10, Line 2, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 10, Line 5, delete "siad" and insert --said--.

Col. 10, Line 6, delete "siad" and insert --said--.

Col. 10, Line 6, delete "heta" and insert --heat--.

Col. 10, Line 8, delete "siad" and insert --said--.

Col. 10, Line 8, delete "tnak" and insert --tank--.

Col. 10, Line 10, delete "ater" and insert --water--.

Col. 10, Line 10, delete "siad" and insert --said--.

Col. 10, Line 11, delete "siad" and insert --said--.

Col. 10, Line 12, delete "siad" and insert --said--.

Col. 10, Line 13, delete "conencted" and insert --connected--.

Col. 10, Line 13, delete "siad" and insert --said--.

Col. 10, Line 14, delete "siad" first occurrence and insert --said--.

Col. 10, Line 14, delete "siad" second occurrence and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 10, Line 15, delete "measn" and insert --means--.

Col. 10, Line 15, delete "siad" first occurrence and insert --said--.

Col. 10, Line 15, delete "siad" second occurrence and insert --said--.

Col. 10, Line 16, delete "siad" and insert --said--.

Col. 10, Line 18, delete "siad" and insert --said--.

Col. 10, Line 20, delete "positioend" and insert --positioned--.

Col. 10, Line 20, delete "siadh ousing" and insert --said housing--.

Col. 10, Line 22, delete "siad" and insert --said--.

Col. 10, Line 25, delete "siad" and insert --said--.

Col. 10, Line 26, delete "siad" and insert --said--.

Col. 11, Line 11, delete "comprsing" and insert --comprising--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 11, Line 12, delete "positoiend" and insert --positioned--.

Col. 11, Line 14, delete "positoend" and insert --positioned--.

Col. 11, Line 15, delete "siad" and insert --said--.

Col. 11, Line 16, delete "incuding" and insert --including--.

Col. 11, Line 17, delete "therin" and insert --therein--.

Col. 11, Line 18, delete "siad" and insert --said--.

Col. 11, Line 19, delete "includnig" and insert --including--.

Col. 11, Line 21, delete "siad" and insert --said--.

Col. 11, Line 22, delete "beign" and insert --being--.

Col. 11, Line 23, delete "commucnation" and insert --communication--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 11, Line 23, delete "siad" and insert --said--.

Col. 11, Line 24, delete "comrising" and insert --comprising--.

Col. 11, Line 26, delete "siad" and insert --said--.

Col. 11, Line 27, delete "exchaust" and insert --exhaust--.

Col. 11, Line 27, delete "siad" and insert --said--.

Col. 11, Line 28, delete "ajdacnet" and insert --adjacent--.

Col. 11, Line 29, delete "siad" and insert --said--.

Col. 11, Line 30, delete "comrising" and insert --comprising--.

Col. 11, Line 31, delete "lowr" and insert --lower--.

Col. 11, Line 31, delete "siad" and insert --said--.

Col. 11, Line 32, delete "camber" and insert --chamber--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 11, Line 32, delete "siad" and insert --said--.

Col. 11, Line 34, delete "postioend" and insert --positioned--.

Col. 11, Line 35, delete "cmoprising" and insert --comprising--.

Col. 11, Line 37, delete "siad" and insert --said--.

Col. 11, Line 38, delete "siad" and insert --said--.

Col. 11, Line 38, delete "parimary" and insert --primary--.

Col. 11, Line 38, delete "exchangr" and insert --exchanger--.

Col. 11, Line 39, delete "bineg" and insert --being--.

Col. 11, Line 39, delete "fulid" and insert --fluid--.

Col. 11, Line 39, delete "siad" and insert --said--.

Col. 11, Line 41, delete "conected" and insert --connected--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 11, Line 41, delete "commucnation" and insert --communication--.

Col. 11, Line 42, delete "exchangr" and insert --exchanger--.

Col. 11, Line 42, delete "ciraulting" and insert --circulating--.

Col. 11, Line 42, delete "rom" and insert --from--.

Col. 11, Line 42, delete "siad" and insert --said--.

Col. 11, Line 43, delete "tnak" and insert --tank--.

Col. 11, Line 43, delete "siad" and insert --said--.

Col. 11, Line 43, delete "excanger" and insert --exchanger--.

Col. 11, Line 44, delete "siad" and insert --said--.

Col. 11, Line 45, delete "mnas" and insert --means--.

Col. 11, Line 45, delete "opratively" and insert --operatively--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 11, Line 46, delete "siad" and insert --said--.

Col. 11, Line 47, delete "actvating" and insert --activating--.

Col. 11, Line 47, delete "siad" and insert --said--.

Col. 11, Line 48, delete "siad" and insert --said--.

Col. 11, Line 50, delete "siad" and insert --said--.

Col. 11, Line 52, delete "accoring" and insert --according--.

Col. 11, Line 53, delete "siad" and insert --said--.

Col. 11, Line 54, delete "siad" and insert --said--.

Col. 12, Line 46, delete "comprsing" and insert --comprising--.

Col. 12, Line 51, delete "posiionted" and insert --positioned--.

Col. 12, Line 51, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 12, Line 52, delete "connectd" and insert --connected--.

Col. 12, Line 52, delete "siad" and insert --said--.

Col. 12, Line 52, delete "thereo" and insert --thereof--.

Col. 12, Line 53, delete "tue" and insert --tube--.

Col. 12, Line 55, delete "siad" and insert --said--.

Col. 12, Line 57, delete "siad" and insert --said--.

Col. 12, Line 59, delete "teh" and insert --a--.

Col. 12, Line 60, delete "siad" and insert --said--.

Col. 12, Lines 63-64, delete "a heat exchanger positioned within siad ousing and including means for controlling gas flow thereto;"

Col. 12, Line 65, delete "siad" and insert --said--.

Col. 12, Line 66, delete "positoiend" and insert --positioned--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 12, Line 66, delete "siad" first occurrence and insert --said--.

Col. 12, Line 66, delete "ousng" and insert --housing--.

Col. 12, Line 66, delete "siad" second occurrence and insert --said--.

Col. 12, Line 67, delete "loer" and insert --lower--.

Col. 12, Line 68, delete "siad" and insert --said--.

Col. 13, Line 1, delete "rleatively" and insert --relatively--.

Col. 13, Line 2, delete "fulid" and insert --fluid--.

Col. 13, Line 3, delete "siad" and insert --said--.

Col. 13, Line 4, delete "siad" and insert --said--.

Col. 13, Line 5, delete "siad" and insert --said--.

Col. 13, Line 6, delete "chagner" and insert --changer--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 13, Line 7, delete "siad" and insert --said--.

Col. 13, Line 9, delete "mnas" and insert --means--.

Col. 13, Line 9, delete "opratively" and insert --operatively--.

Col. 13, Line 10, delete "siad" and insert --said--.

Col. 13, Line 11, delete "actvating" and insert --activating--.

Col. 13, Line 11, delete "siad" and insert --said--.

Col. 13, Line 12, delete "siad" and insert --said--.

Col. 13, Line 14, delete "siad" and insert --said--.

Col. 13, Line 16, delete "siad" and insert --said--.

Col. 16, Line 1, delete "provdiing" and insert --providing--.

Col. 16, Line 2, delete "abuilding" and insert --a building--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 2, delete "siad" and insert --said--.

Col. 16, Line 4, delete "buld-" and insert -- build- --.

Col. 16, Line 6, delete "positioend" and insert --positioned--.

Col. 16, Line 6, delete "siad" and insert --said--.

Col. 16, Line 8, delete "teh" and insert --the--.

Col. 16, Line 9, delete "siad" and insert --said--.

Col. 16, Line 12, delete "siad" and insert --said--.

Col. 16, Line 13, delete "siad" and insert --said--.

Col. 16, Line 13, delete "heta" and insert --heat--.

Col. 16, Line 15, delete "siad" and insert --said--.

Col. 16, Line 15, delete "tnak" and insert --tank--.

Col. 16, Line 17, delete "ater" and insert --water--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 17, delete "siad" and insert --said--.

Col. 16, Line 18, delete "siad" and insert --said--.

Col. 16, Line 19, delete "siad" and insert --said--.

Col. 16, Line 20, delete "conencted" and insert --connected--.

Col. 16, Line 20, delete "siad" and insert --said--.

Col. 16, Line 21, delete "siad" first occurrence and insert --said--.

Col. 16, Line 21, delete "siad" second occurrence and insert --said--.

Col. 16, Line 22, delete "measn" and insert --means--.

Col. 16, Line 22, delete "siad" first occurrence and insert --said--.

Col. 16, Line 22, delete "siad" second occurrence and insert --said--.

Col. 16, Line 23, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 25, delete "siad" and insert --said--.

Col. 16, Line 28, delete "measn" and insert --means--.

Col. 16, Line 28, delete "communiation" and insert --communication--.

Col. 16, Line 28, delete "siad" and insert --said--.

Col. 16, Line 30, delete "stroage" and insert --storage--.

Col. 16, Line 31, delete "siad" and insert --said--.

Col. 16, Line 31, delete "stroage" and insert --storage--.

Col. 16, Line 33, after "apparatus" insert --according--.

Col. 16, Line 33, delete "siad" and insert --said--.

Col. 16, Line 34, delete "siad" and insert --said--.

Col. 16, Line 41, delete "positiond" and insert --positioned--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 41, delete "siad" and insert --said--.

Col. 16, Line 42, delete "conected" and insert --connected--.

Col. 16, Line 42, delete "siad" and insert --said--.

Col. 16, Line 46, delete "siad" and insert --said--.

Col. 16, Line 46, delete "stoage" and insert --storage--.

Col. 16, Line 47, delete "siad" and insert --said--.

Col. 16, Line 47, delete "feezing" and insert --freezing--.

Col. 16, Line 48, delete "therin" and insert --therein--.

Col. 16, Line 50, delete "buiding" and insert --building--.

Col. 16, Line 50, delete "siad" and insert --said--.

Col. 16, Line 51, delete "prisign:" and insert --prising:--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 52, delete "buld-" and insert -- build- --.

Col. 16, Line 54, delete "positioend" and insert --positioned--.

Col. 16, Line 54, delete "siad" and insert --said--.

Col. 16, Line 56, delete "teh" and insert --the--.

Col. 16, Line 57, delete "siad" and insert --said--.

Col. 16, Line 60, delete "siad" and insert --said--.

Col. 16, Line 61, delete "siad" and insert --said--.

Col. 16, Line 61, delete "heta" and insert --heat--.

Col. 16, Line 63, delete "siad" and insert --said--.

Col. 16, Line 63, delete "tnak" and insert --tank--.

Col. 16, Line 65, delete "ater" and insert --water--.

Col. 16, Line 65, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 16, Line 66, delete "siad" and insert --said--.

Col. 16, Line 67, delete "siad" and insert --said--.

Col. 17, Line 1, delete "conencted" and insert --connected--.

Col. 17, Line 1, delete "siad" and insert --said--.

Col. 17, Line 2, delete "siad" first occurrence and insert --said--.

Col. 17, Line 2, delete "siad" second occurrence and insert --said--.

Col. 17, Line 3, delete "measn" and insert --means--.

Col. 17, Line 3, delete "siad" first occurrence and insert --said--.

Col. 17, Line 3, delete "siad" second occurrence and insert --said--.

Col. 17, Line 4, delete "siad" and insert --said--.

Col. 17, Line 6, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 17, Line 7, after "temperature;" delete --and--.

Col. 17, Line 8, delete "positioend" and insert --positioned--.

Col. 17, Line 8, delete "siadh ousing" and insert --said housing--.

Col. 17, Line 10, delete "siad" and insert --said--.

Col. 18, Line 1, delete "siad" and insert --said--.

Col. 18, Line 2, delete "siad" and insert --said--.

Col. 18, Line 5, delete "measn" and insert --means--.

Col. 18, Line 5, delete "iclduing" and insert --including--.

Col. 18, Line 5, delete "secodn" and insert --second--.

Col. 18, Line 6, delete "comunication" and insert --communication--.

Col. 18, Line 6, delete "siad" and insert --said--.

UNITED STATES PATENT AND TRADEMARK OFFICE

CERTIFICATE OF CORRECTION

PATENT NO. : 5,203,500

DATED : April 20, 1993

INVENTOR(S) : Frank L. Horne, Sr.

It is certified that error appears in the above-identified patent and that said Letters Patent is hereby corrected as shown below:

Col. 18, Line 7, delete "circulatign" and insert --circulating--.

Col. 18, Line 7, delete "siad" and insert --said--.

Col. 18, Line 8, delete "siad" and insert --said--.

Signed and Sealed this

Nineteenth Day of October, 1993

Bruce Lehman

*Attest:*

BRUCE LEHMAN

*Attesting Officer*

*Commissioner of Patents and Trademarks*